US007081172B2

(12) United States Patent
Enya et al.

(10) Patent No.: US 7,081,172 B2
(45) Date of Patent: Jul. 25, 2006

(54) NODULAR GRAPHITE CAST IRON WITH HIGH STRENGTH AND HIGH TOUGHNESS

(75) Inventors: Yasuhiro Enya, Kariya (JP); Francois Coderre, Kariya (JP); Yoshikazu Ibayashi, Shimonikawa-gun (JP); Masaru Matukura, Shimonikawa-gun (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 117 days.

(21) Appl. No.: 10/683,391

(22) Filed: Oct. 14, 2003

(65) Prior Publication Data

US 2004/0079450 A1 Apr. 29, 2004

Related U.S. Application Data

(63) Continuation of application No. 10/096,422, filed on Mar. 13, 2002, now abandoned.

(30) Foreign Application Priority Data

Mar. 13, 2001 (JP) ..... 2001-070332

(51) Int. Cl.
*C22C 37/10* (2006.01)
*C22C 37/04* (2006.01)
*C22C 38/08* (2006.01)

(52) U.S. Cl. ..... 148/321; 420/13; 420/25; 420/32; 420/33; 75/567; 75/560

(58) Field of Classification Search ..... 148/321; 420/13

See application file for complete search history.

(56) References Cited

U.S. PATENT DOCUMENTS

| | | | | |
|---|---|---|---|---|
| 4,435,226 | A * | 3/1984 | Neuhauser et al. | 148/545 |
| 5,551,995 | A * | 9/1996 | Nagayoshi | 148/321 |
| 6,746,550 | B1 * | 6/2004 | Hollinger | 148/321 |

FOREIGN PATENT DOCUMENTS

| | | | |
|---|---|---|---|
| JP | 49-21320 | | 2/1974 |
| JP | 49021320 | * | 2/1974 |
| JP | 60-36755 | | 2/1985 |
| JP | 361143554 | * | 7/1986 |
| JP | 63-483 | | 1/1988 |
| JP | 10-237528 | | 9/1998 |
| JP | 2001-073063 | | 3/2001 |
| RU | 1186684 | * | 10/1985 |

OTHER PUBLICATIONS

English abstract of Russian patent 1186684A published Oct. 23, 1985.

* cited by examiner

*Primary Examiner*—Deborah Yee
(74) *Attorney, Agent, or Firm*—Oblon, Spivak, McClelland, Maier & Neustadt, P.C.

(57) ABSTRACT

A nodular graphite cast iron is provided, having a pearlite matrix, with high strength and high toughness. The nodular graphite cast iron consists essentially of, by weight %: from 3.0 to 4.6% of carbon; from 1.6 to 2.5% of silicon; from 0.2 to 0.6% of manganese; from 0.02 to 0.05% of magnesium; from 0.0004 to 0.090% of zirconium; at least one of tin and copper such that $\alpha$ ranges from 0.01 to 0.06% where $\alpha$ indicates a tin conversion amount defined by a summation of a weight % of the tin and 0.1× a weight % of the copper; and the balance of iron and inevitable foreign matters.

20 Claims, 6 Drawing Sheets

FIG. 1
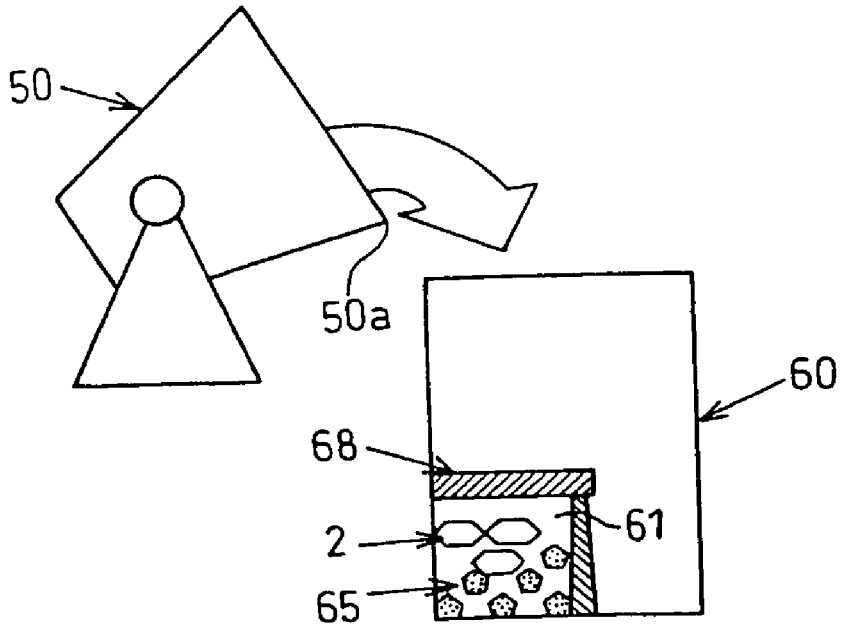
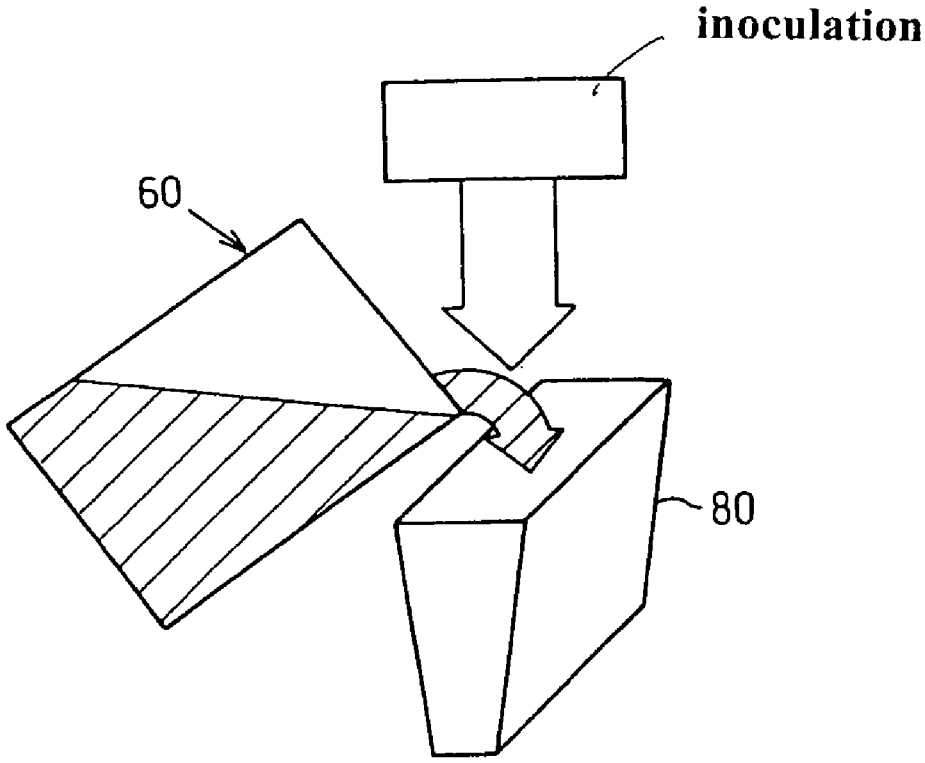
FIG. 2

NODULAR GRAPHITE CAST IRON WITH HIGH STRENGTH AND HIGH TOUGHNESS

This application is a continuation of case Ser. No. 10/096,422 filed Mar. 13, 2002 which has been abandoned.

BACKGROUND OF THE INVENTION

1. Field of the Invention

The present invention is generally directed to a nodular graphite cast iron. In particular, the present invention is directed to a nodular graphite cast iron with high strength and high toughness.

2. Discussion of the Background

In general, automotive products having a thin and lightweight structure are desired. Because many automotive products are formed from nodular graphite cast iron, this desire translates into a need for nodular graphite cast iron to be strengthened, which will allow automotive products to be made thinner and more lightweight.

However, when conventional nodular graphite cast iron is strengthened so that its tensile strength reaches 700 MPa, its impulse value becomes 5 J/cm$^2$ or less. Although this conventional nodular graphite cast iron has high tensile strength, its low toughness limits its use in making thin, lightweight automotive parts.

There is a need for a nodular graphite cast iron combining both high strength and high toughness.

SUMMARY OF THE INVENTION

A first aspect of the present invention provides a nodular graphite cast iron consists essentially of, by weight %: 3.0 to 4.6% of carbon; 1.6 to 2.5% of silicon; 0.2 to 0.6% of manganese; 0.02 to 0.05°% of magnesium; 0.0004 to 0.090% of zirconium; at least one of tin and copper such that α ranges from 0.01 to 0.06% where a indicates a tin conversion amount defined by a summation of a weight % of the tin and 0.1× a weight % of the copper; and the balance of iron and inevitable impurities. This nodular graphite cast iron has been found to exhibit both high strength and high toughness. Without limiting the invention, at present the inventors believe that the combination of high strength and high toughness in a nodular graphite cast iron is achieved is the following manner. When Zr, which constitutes a new treating material to be added to graphite cast iron, is placed inside Si, the Si, instead of the Zr, is oxidized by oxygen in an iron melt. The Zr does not oxidize in the melt. Instead the Zr melts, mixes with the iron melt and becomes part of the resulting graphite cast iron. Deposits including Zr and at least one of Sn and Cu appear evenly around each particle of the cast iron matrix. This results in fine nodular graphite and fine matrix crystal particles around the nodular graphite, thereby increasing the strength and toughness of the nodular graphite cast iron. Electron probe microanalysis (EPMA) has confirmed the formation of fine deposits including Zr and at least one of Sn and Cu appearing evenly around each particle of the cast iron matrix.

The above-mentioned chemical elements are included in the inventive nodular graphite cast iron for the following reasons. Each percentage (%) below is a weight percent.

C: If the amount of C is less than 3%, the amount of graphite is insufficient, resulting in an increase in chill structure in addition to poor fluidity of the molten nodular graphite cast iron, thereby not obtaining the desired high strength. On the other hand, if the amount of C is in excess of 4.6%, the graphite per se becomes brittle or breakable, which makes it impossible to obtain the desired high strength. Thus, the amount of C is 3.0–4.6%, preferably 3.0–4.5%, more preferably 3.6–3.8%. The lower limit of the amount of C can be, for example, 3.1%, 3.2% or 3.3%. The upper limit of the amount of C can be, for example, 4.5%, 4.4% or 4.3%.

Si: if the amount of Si is less than 1.6%, the amount of graphite becomes insufficient, resulting in an increase in chill structure in addition to poor fluidity of the melted graphite, thereby not obtaining the desired high strength. On the other hand, if the amount of Si is in excess of 2.5%, the graphite per se becomes brittle or breakable, which makes the impact strength lower considerably at low temperatures. In addition, the hardness of nodular graphite cast iron decreases, and a nodular graphite cast iron having of high strength is not obtained. Thus, the amount of Si is 1.6–2.5%. The lower limit of the amount of Si can be, for example, 1.7%, 1.8% or 1.9%. The upper limit of the amount of Si can be, for example, 2.4%, 2.3% or 2.2%.

Mn: Mn aids in the formation of pearlite during cooling processes and therefore is very important in controlling the strength of the nodular graphite cast iron. If the amount of Mn is less than 0.2%, then segregation of sulfide in molten nodular graphite cast iron leads to a decrease in the strength of the nodular graphite cast iron. On the other hand, if the amount of Mn is in excess of 0.6%, the resulting promotion of a chill structure increases structures such as cementite and martensite in the matrix. This causes the nodular graphite cast iron to increase in strength and to decrease in machinability, resulting in an impractical nodular graphite cast iron. Thus, the amount of Mn is 0.2–0.6%, preferably 0.3–0.5%, more preferably 0.3–0.4%. The lower limit of the Mn can be, for example, 0.22% or 0.25%. The upper limit of the Mn can be, for example, 0.45% or 0.40%.

Mg: Mg acts as a means for spheroidizing graphite. If the amount of Mg is 0.02% or less, the resulting insufficient spheroidization of graphite causes a stress concentration at an in-matrix graphite deposit portion of the solidified structure, which makes it impossible to a obtain a desired strength. On the other hand, because Mg is very easily oxidized, if the amount of Mg is 0.05% or above, then an in-matrix Mg-oxide is increased to make the matrix lower in strength, which makes it impossible to obtain a desired strength. Thus, the amount of Mg is 0.02–0.05%, preferably 0.03–0.05%, more preferably 0.035–0.045%. The lower limit of the Mg can be, for example, 0.035%. Th upper limit of the Mg can be, for example, 0.048%.

Zr: As previously described, Zr is observed to make the graphite particles in nodular graphite cast iron finer and finer. Thus, Zr increases the structure of the matrix in addition to forming Zr-carbide. If the amount of Zr is 0.0004% or less, the Zr-carbide formed is insufficient to reinforce the matrix and making the graphite particles finer and finer is difficult to realize. Thus, it is impossible to obtain a nodular graphite cast iron which is of high strength. On the other hand, if the amount of Zr is in excess of 0.090%, then spheroidizing of graphite is prevented leading to a stress concentration at an in-matrix graphite deposit portion, which makes it impossible to obtain a desired strength. Thus, the amount of Zr is set to be 0.0004–0.090%, preferably 0.0005–0.080%, more preferably 0.0010–0.070%. The lower limit of Zr can be, for example, 0.0006% or 0.001%. The upper limit Zr can be, for example, 0.085% or 0.075%.

α: α indicates tin conversion amount and is defined as a summation of a weight % of Sn and 0.1× a weight % of Cu. α is set to range from 0.01 to 0.06%. Sn is a chemical element for forming a pearlite and is added in order to reinforce the matrix. Cu is similar to Sn but is of about 1/10 inferior effect when compared to the Sn-effect, resulting in the above-mentioned coefficient: 0.1 with respect to the tin conversion amount. If α is less than 0.01%, then it is difficult to form pearlite sufficiently in the matrix, so that the desired strength is not obtained. On the other hand, if α is in excess of 0.06%, the matrix is lowered considerably in strength to separate a chill structure, resulting in that the formed nodular graphite becomes difficult in machine. Thus, α is set to range from 0.01 to 0.06%, preferably from 0.01 to 0.05%, more preferably from 0.01 to 0.04%. The lower limit of α can be, for example, 0.015% or 0.02%. The upper limit of α can be, for example, 0.045% or 0.04%.

Sn can be used exclusively (i.e., without using Cu), and Cu can be used exclusively (i.e., without using Sn). Of course, both Sn and Cu can be used together. When only Sn, but not Cu, is used, the amount of Sn is 0.01–0.06%, preferably 0.01–0.04%. When only Cu, but not Sn, is used, the amount of Cu is 0.1–0.6%, preferably 0.2–0.4%.

The nodular graphite cast iron has a matrix based on pearlite. The area ratio of the pearlite to the matrix (without graphite) is generally 0.80–0.97, preferably 0.83–0.95%. Generally, ferrite is formed around graphite particles to form a bull's eye structure.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which:

FIG. 1 shows how a spheroidizing process is performed;

FIG. 2 shows how a melted material is poured into a sand mold using an inoculation;

DETAILED DESCRIPTION OF PREFERRED EMBODIMENTS

Figure 3:
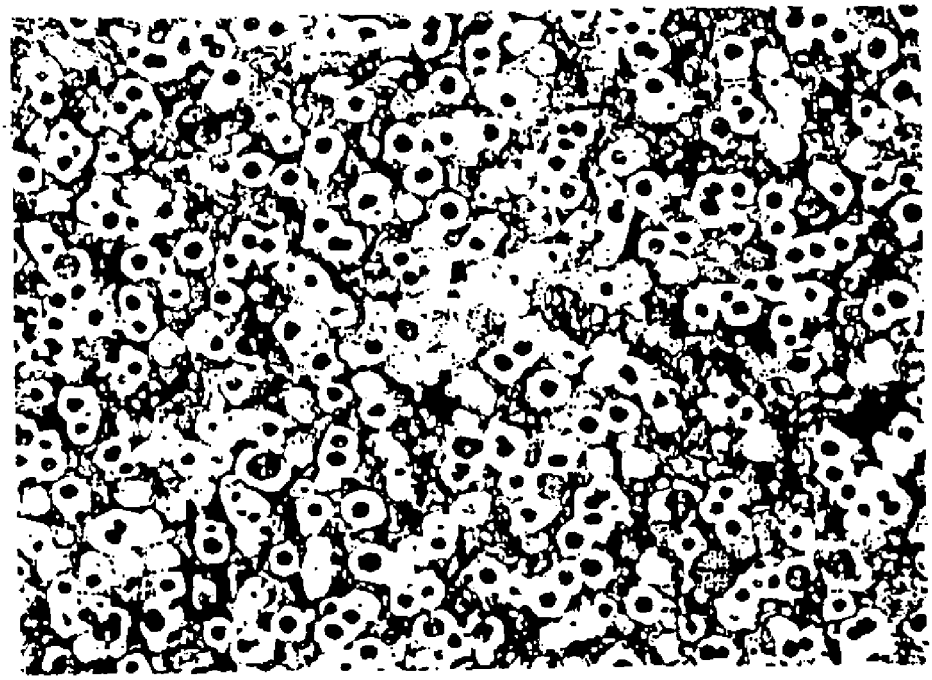
FIG. 3 is a microscopic photograph (×100 magnification) of nodular graphite cast iron according to the present invention.

Embodiments of the present invention will now be described in greater detail with reference to the attached drawings.

As a starting material, nodular graphite cast iron or a pig iron was prepared. After adjusting the contents of ingredients such as C, Si and S, the starting material in amount of 25 kg was put into a high frequency melting furnace 50 and was heated up to a temperature of 1580° C. to melt. Thereafter, proper or adequate amounts of substances such as C, Si, Mn, Sn, and Cu were added to the melted starting material to adjust the contents. When the added substances were fully mixed in the melted starting material and the melted starting material attained again the temperature of 1550° C. or above, the melting furnace 50 was brought into tilt or inclination as illustrated in FIG. 1 to pour or tap the melted material via an outlet 50*a* of the melting furnace 50 into a ladle 60. At the bottom of the ladle 60 was provided a spheroidizing material 65 of the Mg family having an average particle diameter of 5.0–1.5 mm and a treating material 2 having an average particle diameter of 1.0–3.0 mm. In detail, at the bottom of the ladle 60 there was formed a chamber 61. In the chamber 61, the spheroidizing material 65 of the Mg family was provided or accommodated and thereon the treating material 2 of the Zr family was provided. The chamber 61 was closed by an iron plate 68. The reason why the treating material 2 was provided on the spheroidizing material 65 is to make the melted material at higher temperature to contact with the treating material 65 for the prevention of possible heat absorption reaction upon direct contact of the melted material with the spheroidizing material 65. It is to be noted that the above-indicated particle diameters are exemplary and are not limited values.

Figure 6:
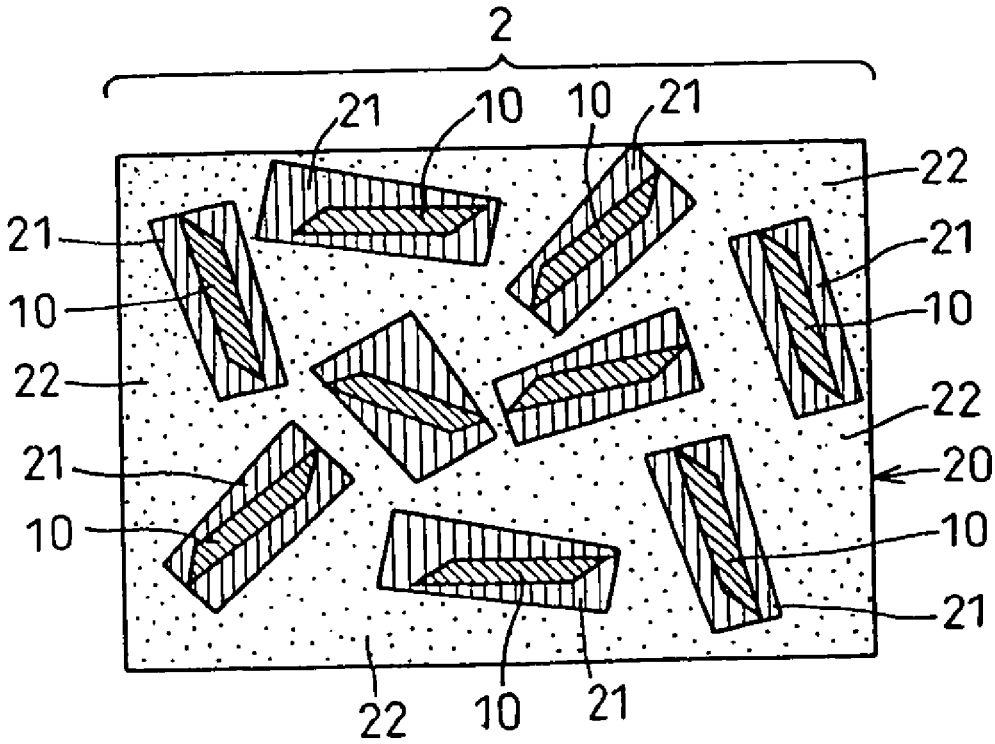
FIG. 6 is a schematic of a Zr family treating material.

Referring to FIG. 6, there is illustrated a conceptual structure illustration of the treating material 2. The treating material 2 included a plurality of inner layers 10 which was formed of Zr—Si—Fe family alloy. Each of the inner layers 10 was covered with a first outer layer 21 formed of a Si-family alloy. The first outer layers 21 including or accommodating therein the respective inner layers 10 were covered with or accommodated in a second or common outer layer 22. As a whole each of the inner layers 10 was covered with or accommodated in an outer layer 20 which was made up of the second outer layer 22 and the first outer layer 21.

The inner layer 10 is formed of the Zr—Si—Fe family and contained 58% Zr, 35% Si and 7% Fe. The inner layer 10 had a melting point of about 1600° C. The inner layer 10 formed about 13% by weight of the treating material 2. The inner layer 10 had an average particle diameter of 40–60 μm (50 μm).

The first outer layer 21 had a melting point of about 1414° C. and was essentially Si. The first outer layer 21 formed about 47% by weight of the treating material 2. The first outer layer 21 had an average particle diameter of 60–150 μm (100 μm).

The second outer layer 22 was the outermost layer, had a melting point of about 1220° C., and was formed of a Fe—Si alloy. The second outer layer 22 contained about 56% Si and about 42% Fe. The second outer layer 22 formed about 40 weight % of the treating material 2.

As described above, it was possible to make the melted material spheriodized by tapping the melted material at higher temperature into the ladle 60 in which was previously provided the Mg-family spheroidizing material 65 and the Zr-family treating material 2. After the spheroidizing process, as shown in FIG. 2, the ladle 60 was tilted to tap the melted material accommodated therein into a sand mold 80 for a Y-block (JIS-G5502 B-type test piece). After solidification in the sand mold 80, inventive members (No. 1–No. 11) were obtained as test pieces.

At this stage, it should be noted that the above-mentioned Zr-including treating material 2 provided remarkable advantages. In general, when a treating material which includes Zr is put into molten iron, the Zr, which has a higher melting point than iron, is oxidized starting with the surface of the Zr. The oxidized surface of the Zr is believe to prevent Zr from spreading into the molten iron. However, with the above-described and newly provided treating material 2, before the inner layer 10 whose main portion is Zr is contacted with the molten iron the first outer layer 21 and second outer layer 22 are subject to contact with the molten iron. As a result, Si contained in the first outer layer 21 and the second outer layer 22 is bonded to oxygen in the molten iron to produce silicon oxide and consume the oxygen in the molten iron. When the inner layer 10 whose main portion is Zr is finally brought into contact with the molten iron, the amount of the oxygen in the molten iron near the treating material 2 is very small and Zr oxidation is minimized. This results in rapid dispersion of the Zr into the molten iron. It should be emphasized that the treating material 2 as detailed above is not disclosed in any conventional or known documents such as Japanese Patent Publication No. Sho. 63(1983)-483 and Japanese Patent Laid-open Print No. Hei. 10(1994)-237528.

The pouring of molten material into the sand mold described above was performed in such a manner that the molten material was kept at a temperature of 141° C. or above and was added with an inoculation such as ferrosilicon. In such case, the pouring the molten material into the sand mold 80 was initiated within 8 minute after completion of the spheroidizing process in order to restrict a fading effect.

TABLE 1

| Piece | Composition (weight %) | | | | | | | |
|---|---|---|---|---|---|---|---|---|
| No. | C | Si | Mn | Mg | Sn | Cu | Zr | Fe |
| 1 | 3.00 | 1.60 | 0.20 | 0.030 | 0.010 | 0.250 | 0.0005 | Bal. |
| 2 | 3.21 | 2.50 | 0.50 | 0.040 | 0.015 | 0.300 | 0.0080 | Bal. |
| 3 | 3.53 | 2.39 | 0.39 | 0.043 | 0.040 | 0.195 | 0.0502 | Bal. |
| 4 | 3.80 | 2.00 | 0.20 | 0.040 | 0.025 | 0.200 | 0.0700 | Bal. |
| 5 | 4.02 | 2.30 | 0.45 | 0.045 | 0.045 | 0.000 | 0.0804 | Bal. |
| 6 | 4.56 | 2.33 | 0.32 | 0.038 | 0.040 | 0.051 | 0.0253 | Bal. |
| 7 | 3.00 | 2.30 | 0.30 | 0.036 | 0.043 | 0.000 | 0.0450 | Bal. |
| 8 | 3.70 | 2.42 | 0.37 | 0.038 | 0.030 | 0.180 | 0.0500 | Bal. |
| 9 | 3.50 | 2.39 | 0.39 | 0.043 | 0.040 | 0.100 | 0.0310 | Bal. |
| 10 | 3.80 | 2.10 | 0.20 | 0.040 | 0.025 | 0.250 | 0.0300 | Bal. |
| 11 | 3.11 | 2.30 | 0.45 | 0.045 | 0.040 | 0.005 | 0.0604 | Bal. |
| CP.1 | 2.50 | 2.60 | 0.35 | 0.038 | 0.070 | 0.100 | 0.0300 | Bal. |
| CP.2 | 3.80 | 1.50 | 0.20 | 0.100 | 0.000 | 0.200 | 0.1000 | Bal. |
| CV.1 | | | | FCD700 | | | | |
| CV.2 | | | | FCD450 | | | | |

Notes
CP.1: Comparative Example 1
CP.2: Comparative Example 2
CV.1: Conventional Example 1
CV.2: Conventional Example 2

TABLE 1 indicates compositions of inventive materials (No. 1–No. 11). In TABLE 1, "Bal." indicates the substantial remaining amount. As apparent from TABLE 1, each of the inventive materials consists essentially of, by weight %, from 3.0 to 4.6% of carbon; from 1.6 to 2.5% of silicon; from 0.2 to 0.6% of manganese; from 0.02 to 0.05% of magnesium; from 0.0004 to 0.090% of zirconium; at least one of tin and cooper such that $\alpha$ ranges from 0.01 to 0.06% where $\alpha$ indicates a tin conversion amount defined by the summation of a weight % of the tin and 0.1× a weight % of the cooper; and the balance comprising an iron and inevitable foreign matters. Amounts of S and P as the foreign matters were 0.02% or less and 0.1% or less, respectively, by weight %.

In a manner similar to the above-described process, each of comparative examples 1 and 2 was obtained in the form of a non-heat treated nodular graphite cast iron. The comparative example 1 was produced similar to each of the inventive materials except that an amount of Sn was set to be slightly larger than that in the inventive material. The comparative example 2 was produced similar to each of the inventive materials except that amounts of Mg and Zr were set to be slightly larger than those in the inventive material.

In addition, a conventional example 1 of non-heat treated type high strengthened nodular graphite cast iron, available as FCD700 (JIS G 5502), was produced. Another conventional example 2, available as FCD450, was similarly produced. FCD450 consists of, by weight %, carbon in amount of 2.5% or above, silicon in amount of 2.7% or less, manganese in amount of 0.4% or less, magnesium in amount of 0.09%, phosphorus in amount of 0.08% or less and sulfur in amount of 0.02% or less. FCD700 is similar to FCD450 in composition except for the addition of a very small amount of tin. FCD700 does not contain additional zirconium.

FIG. 3 illustrates the microstructure of the inventive material (No. 2) when observed by a light microscope (magnification: ×100). As FIG. 3 illustrates, the nodular graphite was found to be very, very fine and its particle number was very, very large. In addition, a ferrite was produced around the nodular graphite, forming a so-called bull's eye structure. It is natural to conclude that when the nodular graphite cast iron has a fine microstructure, the crystal particle of the matrix can be very, very minute from the view point of metallography, to the point that determining the size of the crystal particle of a pearlite structure is difficult by light microscopy.

Figure 4:
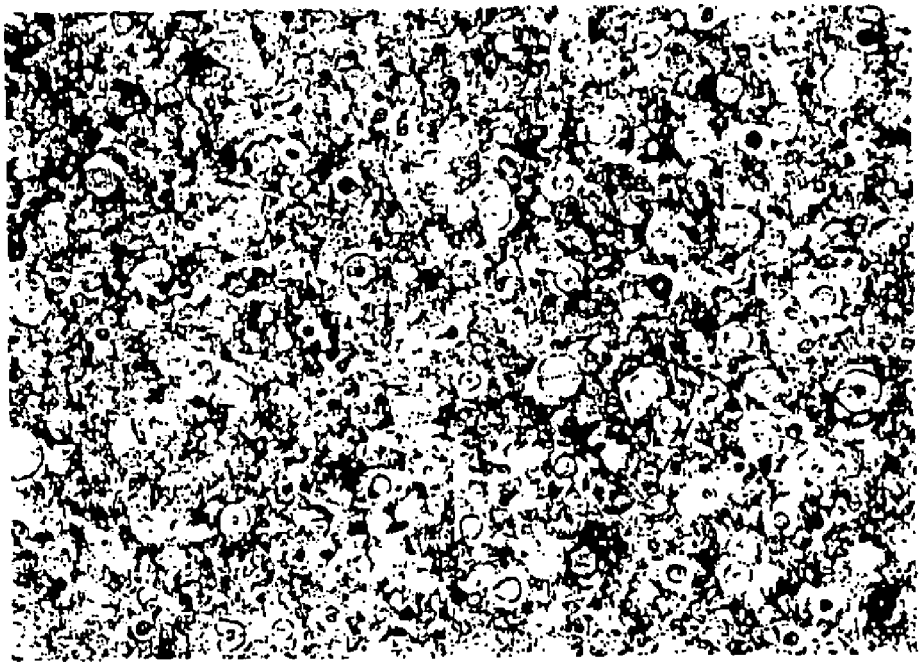
FIG. 4 is a microscopic photograph (×100 magnification) of a conventional example (FCD700)

FIG. 4 illustrates the microstructure of the conventional example 1, i.e., the non heat-treated high strengthened cast iron FCD700 (JIS 65503), when observed by a light microscope (magnification=×100). Obviously, the nodular graphite shown in FIG. 4 is relatively large and smaller in number when compared to the nodular graphite in FIG. 3. In addition, despite of formation of a so-called bull's eye structure, i.e., ferrite formation around the nodular graphite, the ratio of the ferrite around the nodular graphite is small when compared to that in FIG. 3.

Figure 5:
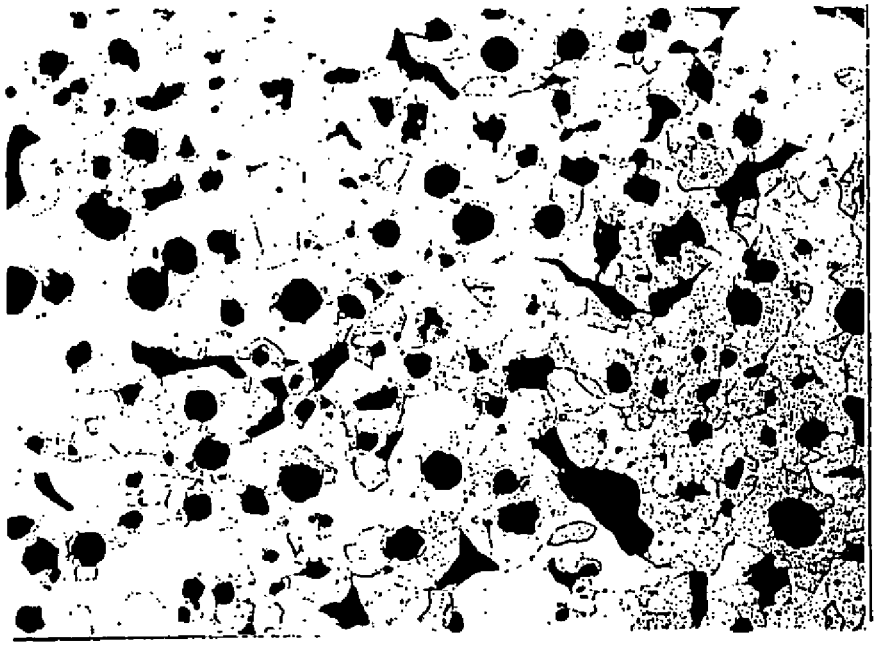
FIG. 5 is a microscopic photograph (×100 magnification) of another conventional example (FCD450)

FIG. 5 illustrates the microstructure of the conventional example 2, i.e., the non heat-treated high strengthened cast iron FCD450, when observed by a light microscope (magnification:×100). The matrix regions of the FCD450 were mostly ferrite. The nodular graphite is relatively large and smaller in number as shown in FIG. 5.

TABLE 2 below provides results of tests showing characteristics of the inventive material (No. 2) and the conventional example 2. The inventive material (No. 2) has a spheroidizing ratio of as high as 85.8%, like the FCD450, and its graphite number is 134 particles per $mm^2$, which is considerably larger than that of the FCD450. In other words, the number of graphite particles in the inventive material is 1.6 times (≈134/82) that of the FCD450 (with 82 particles per $mm^2$). The inventive material (No. 2) has a graphite particle diameter of 41.7 μm, which is considerably smaller than the 66.2 μm particle diameter of the FCD450. Thus, in the inventive material (No. 2) very finite nodular graphite and an increase particle number are found.

TABLE 2

| | Conventional Example 2 | Inventive Material No. 2 |
|---|---|---|
| Graphite number (particles/$mm^2$) | 82 | 134 |
| Graphite particle diameter (μm) | 66.2 | 41.7 |
| Spheroidizing ratio % | 86.9 | 85.8 |
| Pearlite ratio % | 13 | 66 |

Figure 7:
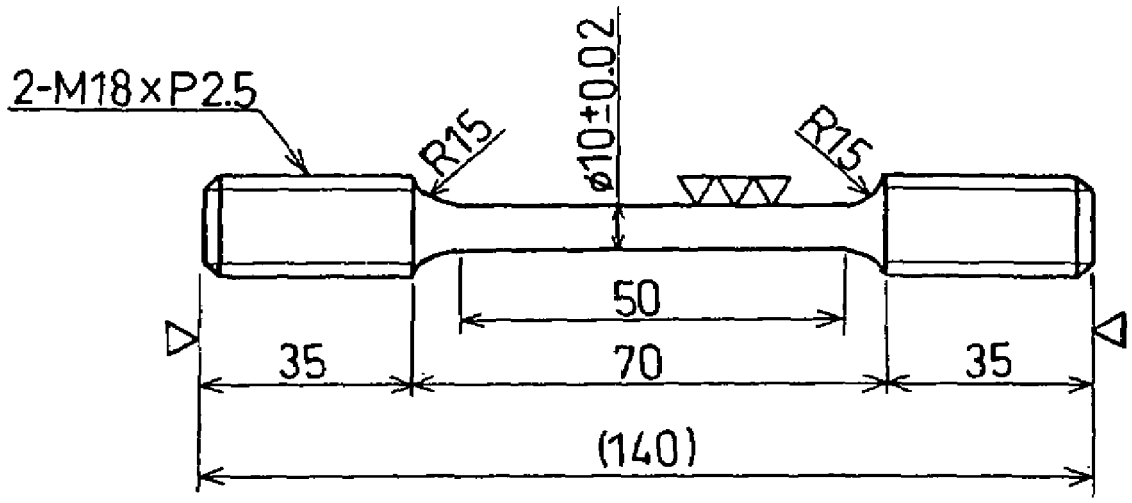
FIG. 7 is a front view of a tensile test piece.
Figure 8A:
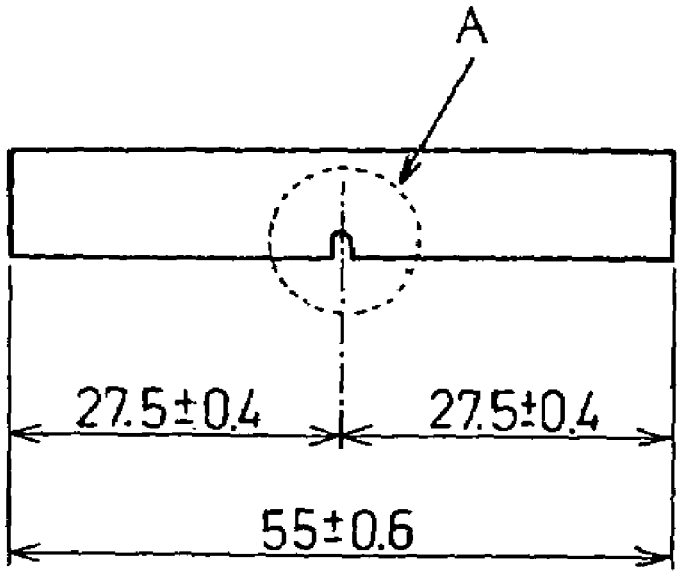
FIG. 8(A) is a front view of an impact test piece.
Figure 8B:
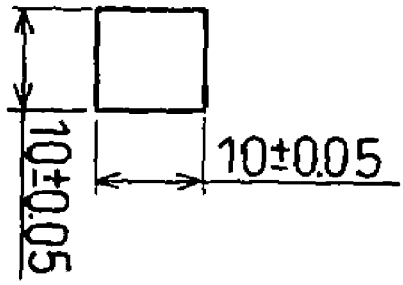
FIG. 8(B) is a side view of the impact test piece.
Figure 8C:
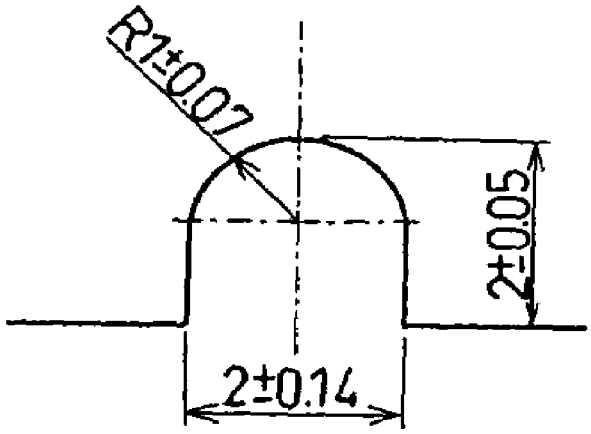
FIG. 8(C) is a front view of the A-portion encircled in FIG. 8(A)

Each of the inventive materials (No. 1–No. 11) was machined to produce a tensile test piece (FIG. 7) and a Charpy impact test piece (JIS Z2202 No. 3) as shown in FIG.

8. With respect to the tensile test piece and the Charpy impact test piece of each of the inventive materials (No. 1–No. 11), tensile and Charpy impact test were conducted. In addition, cutting tests were performed.

The cutting tests were performed to evaluate cutting properties with regard to each of the comparative examples 1 and 2, the conventional examples 1 and 2, and the inventive materials (No. 1–No. 6) which were not heat-treated or were in an as-cast state. These tests were conducted to verify an easy-to-machine property of each inventive material pursuant to the following cutting conditions with usage of generally or commercially available carbide cutting tools. Each of the resulting flank wear ($V_B$) was detected and listed in TABLE 3 as a cutting evaluation result.

Test Conditions
material to be cut: 110 mm (outer diameter)
cutting speed: 150 m/min
feed: 0.15 min/rev
width of cut: 0.3 mm
cutting oil: aqueous cutting oil (Chemi-cool SR-1)
cutting length: 10000 m

TABLE 3

| Test Piece No. | Tensile Strength (MPa) | Charpy Impact Value (J/cm$^2$) | Flank Wear (mm) |
|---|---|---|---|
| 1 | 702.4 | 15.0 | 0.29 |
| 2 | 707.6 | 17.7 | 0.28 |
| 3 | 738.1 | 16.4 | 0.35 |
| 4 | 724.7 | 16.5 | 0.33 |
| 5 | 716.3 | 17.3 | 0.28 |
| 6 | 704.8 | 18.2 | 0.36 |
| 7 | 702.4 | 15.4 | — |
| 8 | 732.2 | 15.7 | — |
| 9 | 709.1 | 15.3 | — |
| 10 | 705.7 | 15.4 | — |
| 11 | 704.3 | 17.3 | — |
| CP. 1 | 802.8 | 2.0 | 0.42 |
| CP. 2 | 661.2 | 17.6 | 0.28 |
| CV. 1 | 732.5 | 3.2 | 0.39 |
| CV. 2 | 482.7 | 19.0 | 0.26 |

Notes:
CP. 1: Comparative Example 1
CP. 2: Comparative Example 2
CV. 1: Conventional Example 1
CV. 2: Conventional Example 2

As TABLE 3 represents, each of the inventive materials (No. 1–No. 11) is of 700 MPa or above in tensile strength and is of 15.0 J/cm$^2$ or above in Charpy impact value. These results show that the inventive nodular graphite cast irons have both high strength and high toughness. In particular, the inventive material No. 2 has a tensile strength of 700 MPa or above and a Charpy impact value of 17.0 J/cm$^2$ or above. The inventive material No. 3 has a tensile strength of 730 MPa or above and a Charpy impact value of 16.0 J/cm$^2$ or above. The invented material No. 4 has a tensile strength of 720 MPa or above and a Charpy impact value of 16.0 J/cm$^2$ or above. The invented material No. 5 has a tensile strength of 710 MPa or above and a Charpy impact value of 17.0 J/cm$^2$ or above. The invented material No. 6 has a tensile strength of 700 MPa or above and a Charpy impact value of 18.0 J/cm$^2$ or above.

In addition, according to TABLE 3, the inventive material No. 7 has a tensile strength of 700 MPa or above and a Charpy impact value of 15.0 J/cm$^2$ or above. The invented material No. 8 has a tensile strength of 730 MPa or above and a Charpy impact value of 15.0 J/cm$^2$ or above. The invented material No. 9 has a tensile strength of 700 MPa or above and a Charpy impact value of 15.0 J/cm$^2$ or above. The invented material No. 10 has a tensile strength of 700 MPa or above and a Charpy impact value of 15.0 J/cm$^2$ or above. The invented material. No. 11 has a tensile strength of 700 MPa or above and a Charpy impact value of 17.0 J/cm$^2$ or above.

Though the comparative example 1, i.e., the nodular graphite cast iron in which a slightly smaller amount of C and a slightly larger amount of Sn were contained, is indicative of an excellent tensile strength of as high as 800 MPa or above, it is indicative of poor toughness due to the fact that the Charpy impact value was as low as of 2 J/cm$^2$. On the other hand, though the comparative example 2, i.e., the nodular graphite cast iron in which a slightly larger amount of Si was contained, is indicative of an excellent toughness due to the fact that the Charpy impact value is about 17 J/cm$^2$, it is indicative of poor tensile strength of about 660 MPa.

The conventional example 1 or FCD700 was, though it was indicative of excellent tensile strength of as high as 730 MPa or above, poor in toughness due to the fact that the Charpy impact value was 3 J/cm$^2$. The conventional example 2 or FCD450 was, though it is indicative of excellent toughness due to the fact the Charpy impact value was as high as about 19 J/cm$^2$, indicative of poor tensile strength which is as low as about 480 MPa.

Even though each of the inventive materials has a relatively high area ratio of pearlite (area ratio: 76–93%), the inventive materials were excellent in cutting properties. The flank wear was restricted and was similar to the flank wear (0.26 mm) of the conventional example 2, which is ferrite where most matrixes were low in hardness. In other words, the flank wear was near the flank wear of ferrite family nodular graphite cast iron, such as the comparative example 2 or the conventional example 2, each of which was of low tensile strength of 670 MPa or less despite being excellent in Charpy impact value. It can be thought that the excellent cutting property of each of the inventive materials was due to very finite nodular graphite and an increased graphite particle number. As can be easily understood from the above test results, each of the inventive materials was of high strength, high toughness, and excellent cutting property, even though it was not heat-treated and was in an as-cast state.

In detail, in view of the above test results, each of the inventive materials (No. 1–No. 11) was found to have a toughness or intensity against impulse equivalent or similar to that of the conventional example 1, which was ferrite family FCD 450, though each inventive material was found to have a structure that was equivalent or similar to pearlite family FCD700 from the view point of metallography. In addition, each inventive material was found to be excellent in an easy-to-cut property like the conventional FCD450. Thus, each of the inventive materials makes it possible to produce long-sought lightweight cast iron products, such as remarkably lightweight automotive parts, at lower costs. Of course, other than automotive parts, the inventive materials can be used for producing general purpose mechanical parts.

Figure 9:
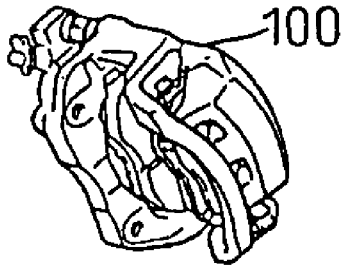
FIGS. 9 through 11 show a variety of automotive products formed using the nodular graphite cast iron of the present invention.
Figure 10:
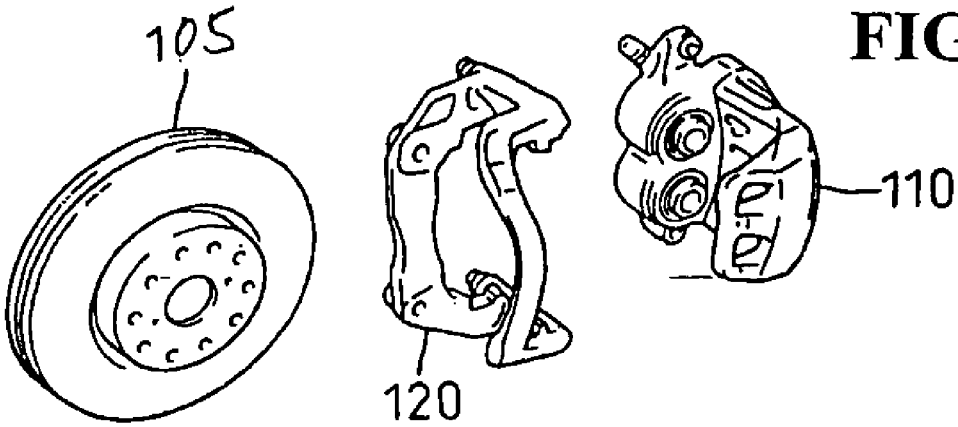
Figure 11:
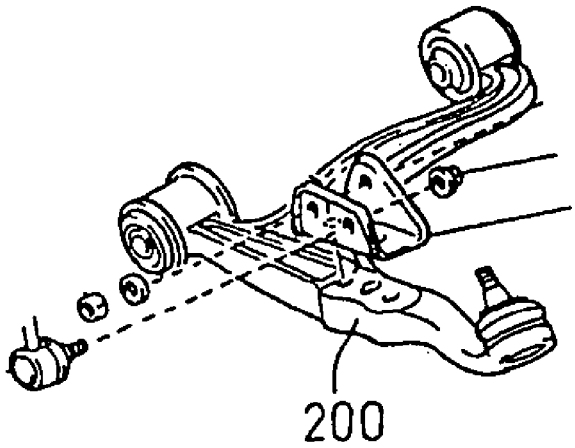

FIG. 9 illustrates a disc brake caliper 100 formed of a nodular graphite cast iron according to the present invention. FIG. 10 illustrates a brake cylinder 110 for braking a disc 105 and a mounting member 120 for supporting the brake cylinder 110, each of the brake cylinder 110 and the mounting member 120 being formed of a nodular graphite cast iron according to the present invention. FIG. 11 depicts a suspension arm 200 formed of a nodular graphite cast iron according to the present invention. The above-mentioned caliper 100, brake cylinder 110, mounting member 120, and suspension arm 200 can be of high strength and high toughness while maintaining an excellent easy-to-cut property, when they are formed of a nodular graphite cast iron according to the present invention, resulting in making each of the members thinner, thereby making it possible to make each of the members extremely lightweight. Thus, each of the resulting members or automotive products can contribute as much as possible to improving the fuel economy of an automotive vehicle.

The present invention is capable of providing a nodular graphite cast iron having high strength and high toughness. Particularly, its tensile strength can attain 700 MPa or above and its impact value can attain 15 J/cm$^2$ or above. These features can be attained even when the nodular graphite cast iron is in a untreated state, particularly in a non-heat-treated state. In addition, the nodular graphite cast iron is easy to cut.

The disclosure of the priority document, Japanese Patent Application No. 2001-070332, filed Mar. 13, 2001, is incorporated by reference herein in its entirety.

The invention has thus been shown and description with reference to specific embodiments, however, it should be understood that the invention is in no way limited to the details of the illustrates structures but changes and modifications may be made without departing from the scope of the appended claims.

What is claimed is:

1. A nodular graphite cast iron consisting essentially of:
from 3.0 to 4.6 weight % of carbon;
from 1.6 to 2.5 weight % of silicon;
from 0.2 to 0.6 weight % of manganese;
from 0.02 to 0.05 weight % of magnesium;
from 0.0004 to 0.090 weight % of zirconium;
at least 0.010 weight % of tin;
copper; and
a balance of iron and inevitable impurities, wherein
the sum of a weight % of the tin and 0.1 times a weight % of the copper ranges from 0.01 to 0.06 weight %; and
the nodular graphite cast iron is produced by a process comprising
heating a melt containing carbon, silicon, manganese, magnesium, zirconium, tin, copper and iron; and
adding to the melt a treating material comprising
a Zr—Si—Fe alloy,
a Si alloy covering the Zr—Si—Fe alloy, and
a Fe—Si alloy covering the Si alloy.

2. The nodular graphite cast iron according to claim 1, wherein the carbon is from 3.1 to 4.5 weight %.

3. The nodular graphite cast iron according to claim 1, wherein the silicon is from 1.7 to 2.4 weight %.

4. The nodular graphite cast iron according to claim 1, wherein the manganese is from 0.3 to 0.5 weight %.

5. The nodular graphite cast iron according to claim 1, wherein the magnesium is from 0.03 to 0.05 weight %.

6. The nodular graphite cast iron according to claim 1, wherein the zirconium is from 0.0005 to 0.080 weight %.

7. The nodular graphite cast iron according to claim 1, wherein the nodular graphite cast iron is a non-heat-treated nodular graphite cast iron.

8. The nodular graphite cast iron according to claim 1, wherein the nodular graphite cast iron has a tensile strength of 700 MPa or more and an impact value of 15 J/cm$^2$ or more.

9. A nodular graphite cast iron consisting essentially of:
from 3.0 to 4.6 weight % of carbon;
from 1.6 to 2.5 weight % of silicon;
from 0.2 to 0.6 weight % of manganese;
from 0.02 to 0.05 weight % of magnesium;
from 0.0004 to 0.090 weight % of zirconium;
at least one of tin and copper such that the sum of a weight % of the tin and 0.1 times a weight % of the copper ranges from 0.01 to 0.06 weight %; and
a balance of iron and inevitable impurities, wherein
the nodular graphite cast iron comprises
particles of a cast iron matrix, and
deposits including Zr and at least one of Sn and Cu appearing evenly around each particle of the cast iron matrix.

10. The nodular graphite cast iron according to claim 9, wherein the carbon is from 3.1 to 4.5 weight %.

11. The nodular graphite cast iron according to claim 9, wherein the silicon is from 1.7 to 2.4 weight %.

12. The nodular graphite cast iron according to claim 9, wherein the manganese is from 0.3 to 0.5 weight %.

13. The nodular graphite cast iron according to claim 9, wherein the magnesium is from 0.03 to 0.05 weight %.

14. The nodular graphite cast iron according to claim 9, wherein the zirconium is from 0.0005 to 0.080 weight %.

15. The nodular graphite cast iron according to claim 9, wherein the nodular graphite cast iron is a non-heat-treated nodular graphite cast iron.

16. A method of making a nodular graphite cast iron, the method comprising
heating a melt containing carbon, silicon, manganese, magnesium, zirconium, iron and at least one of tin and copper;
adding to the melt a treating material comprising
a Zr—Si—Fe alloy,
a Si alloy covering the Zr—Si—Fe alloy, and
a Fe—Si alloy covering the Si alloy; and
producing the cast iron of claim 9.

17. A nodular graphite cast iron consisting of:
from 3.0 to 4.6 weight % of carbon;
from 1.6 to 2.5 weight % of silicon;
from 0.2 to 0.6 weight % of manganese;
from 0.02 to 0.05 weight % of magnesium;
from 0.0004 to 0.090 weight % of zirconium;
at least one of tin and copper such that the sum of a weight % of the tin and 0.1 times a weight % of the copper ranges from 0.01 to 0.06 weight %; and
a balance of iron and inevitable impurities, wherein
the nodular graphite cast iron is produced by a process comprising
heating a melt containing carbon, silicon, manganese, magnesium, zirconium, iron and at least one of tin and copper; and
adding to the melt a treating material comprising
a Zr—Si—Fe alloy,
a Si alloy covering the Zr—Si—Fe alloy, and
a Fe—Si alloy covering the Si alloy.

18. The nodular graphite cast iron according to claim 17, wherein the nodular graphite cast iron has a tensile strength of 700 MPa or more and an impact value of 15 J/cm$^2$ or more.

19. The nodular graphite cast iron according to claim 1, wherein the nodular graphite cast iron comprises particles of a cast iron matrix, and deposits including Zr and at least one of Sn and Cu appearing evenly around each particle of the cast iron matrix.

20. The nodular graphite cast iron according to claim 17, wherein the nodular graphite cast iron comprises particles of a cast iron matrix, and deposits including Zr and at least one of Sn and Cu appearing evenly around each particle of the cast iron matrix.

* * * * *